US006659440B2

(12) United States Patent
Levy

(10) Patent No.: US 6,659,440 B2
(45) Date of Patent: Dec. 9, 2003

(54) PORTABLE SUPPORT ASSEMBLY FOR A WORKPIECE

(75) Inventor: Ronny Levy, Ha'Ayin (IL)

(73) Assignee: Zag Industries Ltd., Rosh Ha'ayin (IL)

( * ) Notice: Subject to any disclaimer, the term of this patent is extended or adjusted under 35 U.S.C. 154(b) by 0 days.

(21) Appl. No.: 10/015,942

(22) Filed: Dec. 17, 2001

(65) Prior Publication Data

US 2002/0105129 A1 Aug. 8, 2002

Related U.S. Application Data

(60) Provisional application No. 60/255,881, filed on Dec. 18, 2000.

(51) Int. Cl.[7] ..... B25B 1/00

(52) U.S. Cl. ..... 269/45; 269/79; 269/88; 269/99; 269/100; 269/244; 269/283; 269/900; 269/901

(58) Field of Search ..... 269/901, 900, 269/79, 244, 283, 99, 100, 88; 144/287; 282/151, 153, 224, 225, 226; 108/6, 8

(56) References Cited

U.S. PATENT DOCUMENTS 4,249,636 A 2/1981 Jackson et al.
4,555,099 A 11/1985 Hilton
4,617,869 A 10/1986 Denomey
4,625,951 A 12/1986 Yang
4,790,411 A 12/1988 Ottoson
5,065,989 A 11/1991 Ho
5,096,019 A 3/1992 Kelsay
5,421,430 A 6/1995 Cox
5,535,847 A 7/1996 Durapau
5,924,684 A 7/1999 Cheng
6,086,073 A 7/2000 Tisbo et al.
6,286,824 B1 * 9/2001 Sagol ..... 269/901

* cited by examiner

*Primary Examiner*—Robert C. Watson
(74) *Attorney, Agent, or Firm*—Pillsbury Winthrop LLP

(57) ABSTRACT

A workpiece support assembly includes an elongated workpiece support structure and a pair of support members pivotally connected to one another towards upper ends thereof. The support members are pivotally movable between an open position and a folded position. The workpiece support structure has a workpiece support surface constructed and arranged to support a portion of a workpiece. The workpiece support assembly further includes a tabletop assembly. The tabletop assembly is movable into a deployed position in which the tabletop is disposed substantially horizontally in overlying relation to the workpiece support structure, with the pair of support members in their open operative position. The deployed tabletop presents an upper tabletop surface to support a workpiece. The tabletop assembly is movable, with the pair of support members in their open operative position, into a storage position which exposes the elongated workpiece support surface.

22 Claims, 18 Drawing Sheets

PORTABLE SUPPORT ASSEMBLY FOR A WORKPIECE

The present application claims priority to U.S. Provisional Application of Levy, Ser. No. 60/255,881, filed Dec. 18, 2000 the entirety of which is hereby incorporated into the present application by reference.

FIELD OF THE INVENTION

The present invention is generally related to portable workpiece support assemblies.

BACKGROUND

Many construction projects require two types of workpiece supports: sawhorses and workbenches. Typically, a sawhorse provides an elongated, relatively narrow support surface that is used to support a portion of a workpiece. For example, sawhorses are frequently used in pairs to support a relatively large workpiece such as a board or a panel of sheet rack or plywood. The sawhorses are usually spaced apart from one another in use supporting a workpiece and each sawhorse supports an end portion of the workpiece. The workpiece support surface of a sawhorse is of relatively little use when used by itself because it is so narrow. Workbenches, on the other hand, provide relatively wide, table-like support surfaces that can be used, for example, to support relatively smaller workpieces in their entirety.

It is inconvenient for workers to carry both a pair of sawhorses and workbench to a work site. These items also require significant storage space when not in use. Workspace is often at a premium at a work site because of the size and number of tools required and because of the size and quantity of building materials. It is therefore desirable that the amount of space required for a sawhorse and a portable workbench be kept to a minimum.

A need exists for a foldable, portable workpiece support assembly that is readily convertible between 1) a sawhorse configuration and 2) a workbench configuration which provides a tabletop having a tabletop surface constructed and arranged to support an entire workpiece in a self-sustaining manner.

SUMMARY OF THE INVENTION

The above identified need can be met by providing a workpiece support assembly that includes an elongated workpiece support structure and a pair of support members. The support members are pivotally connected to one another towards upper ends thereof and are pivotally movable between a) an open operative position and b) a folded position. The pair of support members are constructed and arranged when in their open operative position to support the workpiece support structure horizontally, in spaced relation above a ground surface. The workpiece support structure has an elongated, workpiece support surface constructed and arranged to support a portion of a workpiece. The workpiece support assembly also includes a tabletop assembly. The tabletop assembly includes a tabletop and a tabletop support structure. The tabletop assembly is movable into a deployed position in which the tabletop is disposed substantially horizontally in overlying relation to the workpiece support structure, with the pair of support members in their open operative position. The deployed tabletop presents an upper tabletop surface to support a workpiece. The upper tabletop surface is larger than the elongated, workpiece support surface. The tabletop assembly is movable, with the pair of support members in their open operative position, into a storage position which exposes the elongated workpiece support surface.

The workpiece support assembly can advantageously be used with a vise assembly that includes a housing structure, a movable member movably mounted for movement with respect to the housing structure, and a fixed member. A threaded member is rotatably mounted in the housing structure and is threadedly engaged with the movable member such that rotation of the threaded member moves the movable member with respect to the housing structure. The housing structure and the fixed member are releasably lockable with respect to the tabletop surface when the tabletop assembly is deployed so that a workpiece placed between the movable member and the fixed member can be held in a fixed position with respect to the tabletop surface by moving the movable member against the workpiece by rotating the threaded member so that the workpiece is gripped between the movable member and the fixed member.

Other aspects, features, and advantages of the present invention will become apparent from the following detailed description, the accompanying drawings, and the appended claims.

DETAILED DESCRIPTION

Figure 1:
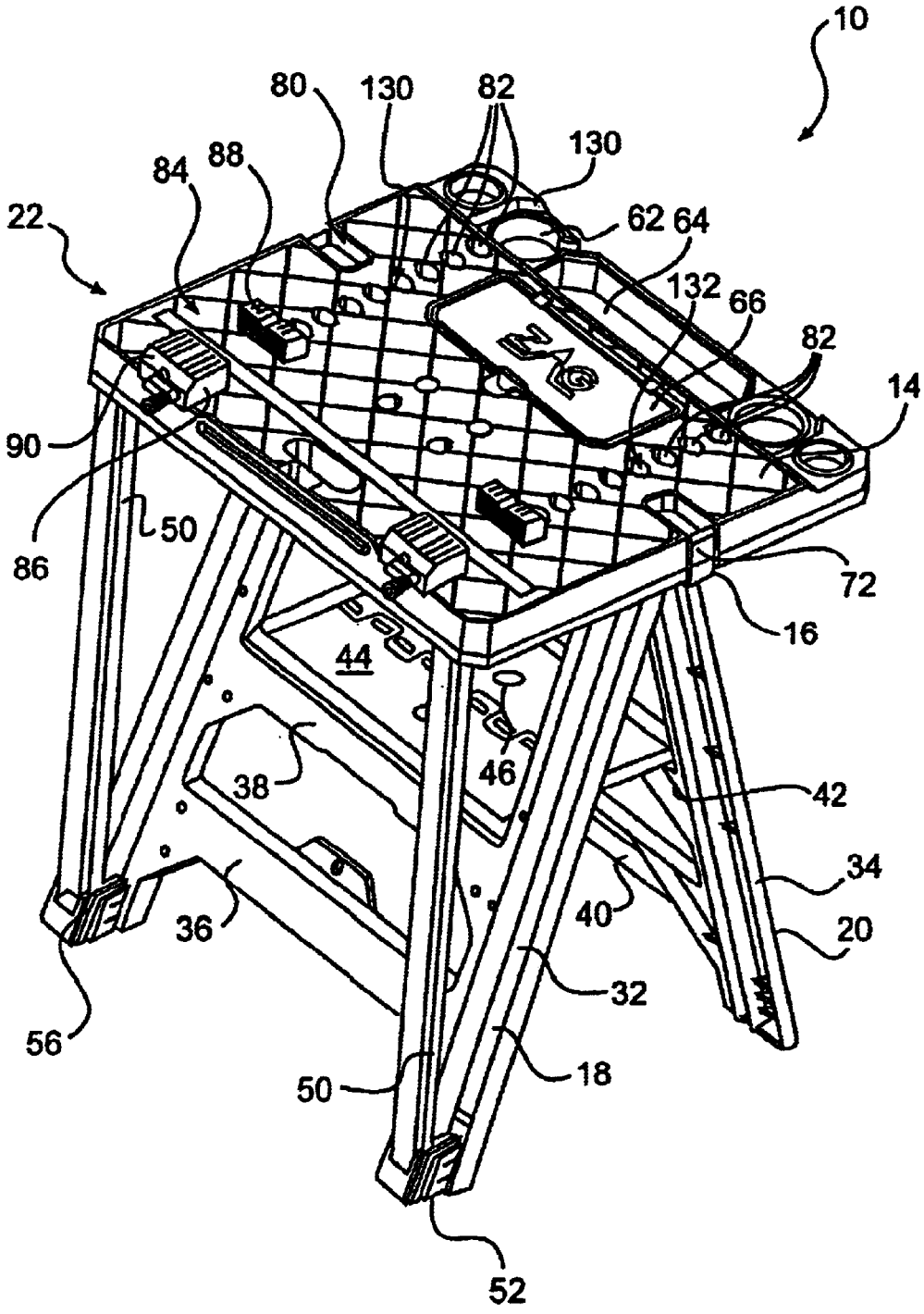
FIG. 1 is a perspective view of a workpiece support assembly constructed according to the principles of the present invention and showing a pair of vise assemblies mounted thereon.

FIG. 1 is a perspective view of a workpiece support assembly 10 constructed according to the principles of the present invention. The workpiece support assembly 10 is convertible between a) a sawhorse configuration (see FIG. 2, for example) which provides an elongated workpiece support surface 12 constructed and arranged to support a portion of a workpiece (not shown), particularly in cooperation with another assembly 10 and b) a workbench configuration (see FIG. 1, for example) which provides a tabletop surface 14 constructed and arranged to support an entire workpiece (not shown) in a self-sustaining manner. The support assembly 10 is foldable into a relatively flat configuration (see FIGS. 3 and 4, for example) to facilitate transport and storage. The flat configuration allows, for example, several support assemblies 10 to be stacked in a pile for storage.

The structure of the workpiece support assembly 10 can best be understood from FIGS. 1–3 and 6. The support assembly 10 includes an elongated support structure 16 and a pair of support members 18, 20. The pair of support members 18, 20 are pivotally connected to one another towards upper ends thereof (in a manner described below). The support members 18, 20 are pivotally movable between a) an open operative position (see FIGS. 1 and 2, for example) and b) a folded position (see FIGS. 3 and 4, for example). The pair of support members 18, 20 support the workpiece support structure 16. Specifically, the pair of support members 18, 20 are constructed and arranged when in their open operative position to support the workpiece support structure 16 horizontally, in spaced relation above a ground surface.

The support assembly 10 further includes a tabletop assembly 22, which provides the tabletop surface 14 when the support assembly 10 is in its workbench configuration. The tabletop assembly 22 includes a tabletop 24 and tabletop support structure 26. The tabletop assembly 22 is movable when the support members 18, 20 are in their open operative position into a deployed position (see FIG. 1, for example) in which the tabletop 24 is disposed substantially horizontally in overlying relation to the workpiece support structure 16 and presents the upper tabletop surface 14 to support a workpiece. The upper tabletop surface is larger than the elongated, workpiece support surface. The tabletop support structure 26 is connected to the tabletop 24 in the workbench configuration (shown in FIG. 1, for example) and cooperates with the workpiece support structure 16 to support the tabletop surface 14 in a level position (relative to a level ground surface). The tabletop assembly 22 is movable into a folded closed or storage position (see FIG. 2, for example) in which the tabletop 24 and the tabletop support structure 26 are adjacent to one of the support members 18. When the tabletop assembly is moved into its storage position, the elongated workpiece support surface of the workpiece support structure is exposed. Thus, the sawhorse configuration of the workpiece support assembly 10 is realized when the tabletop assembly 22 is in its storage position and the support members 18, 20 are in their open operative position (see FIG. 2, for example).

Preferably the workpiece support structure 16, the support members 18, 20, the tabletop 24 and the tabletop support structure 26 are constructed of a high strength, lightweight molded plastic material, although any material of suitable strength, including any appropriate metal, wood, or polymeric material, for example, can be used in all or a portion of their construction.

Figure 2:
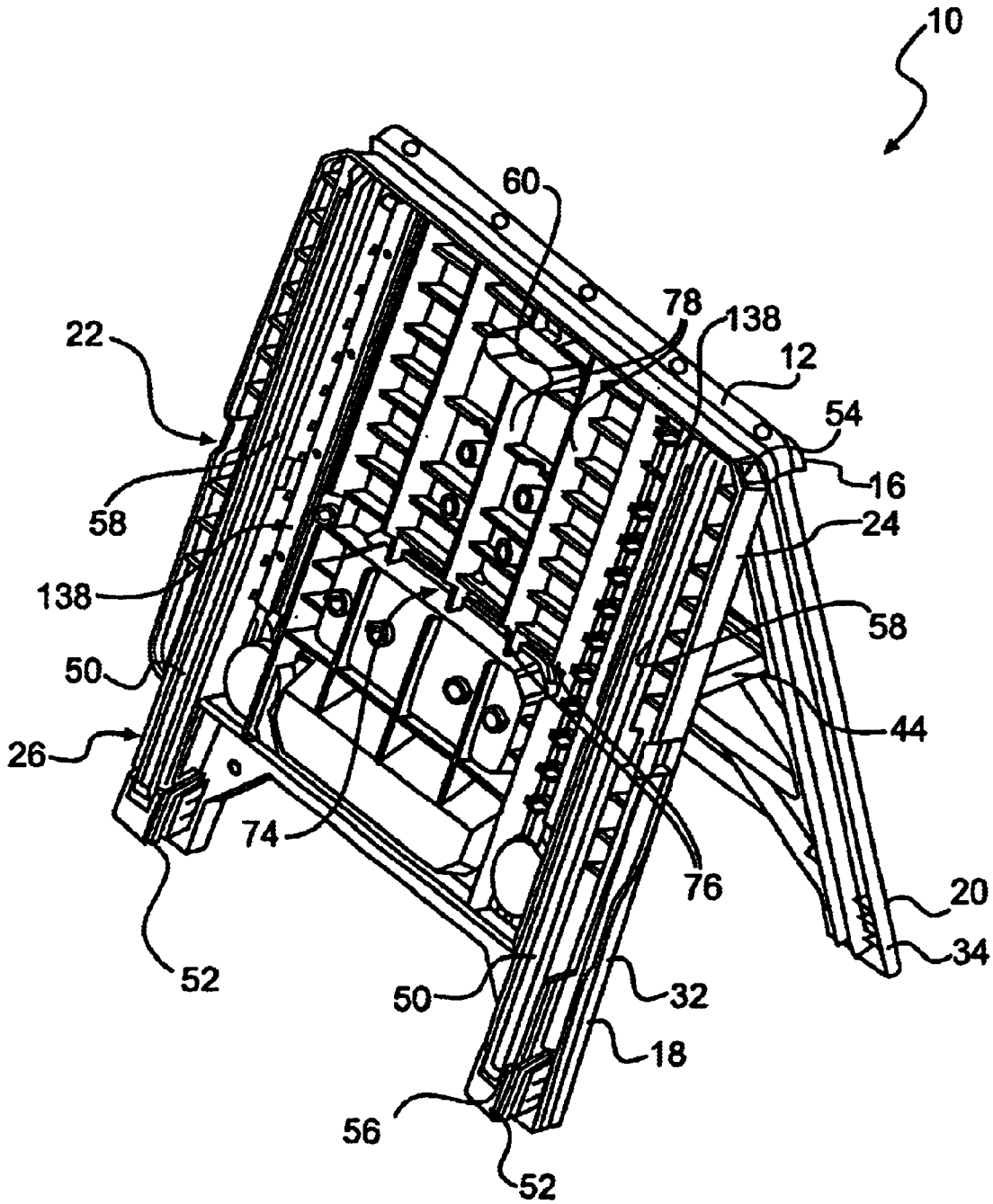
FIG. 2 is a perspective view of the workpiece support assembly showing the assembly in its sawhorse configuration.
Figure 3:
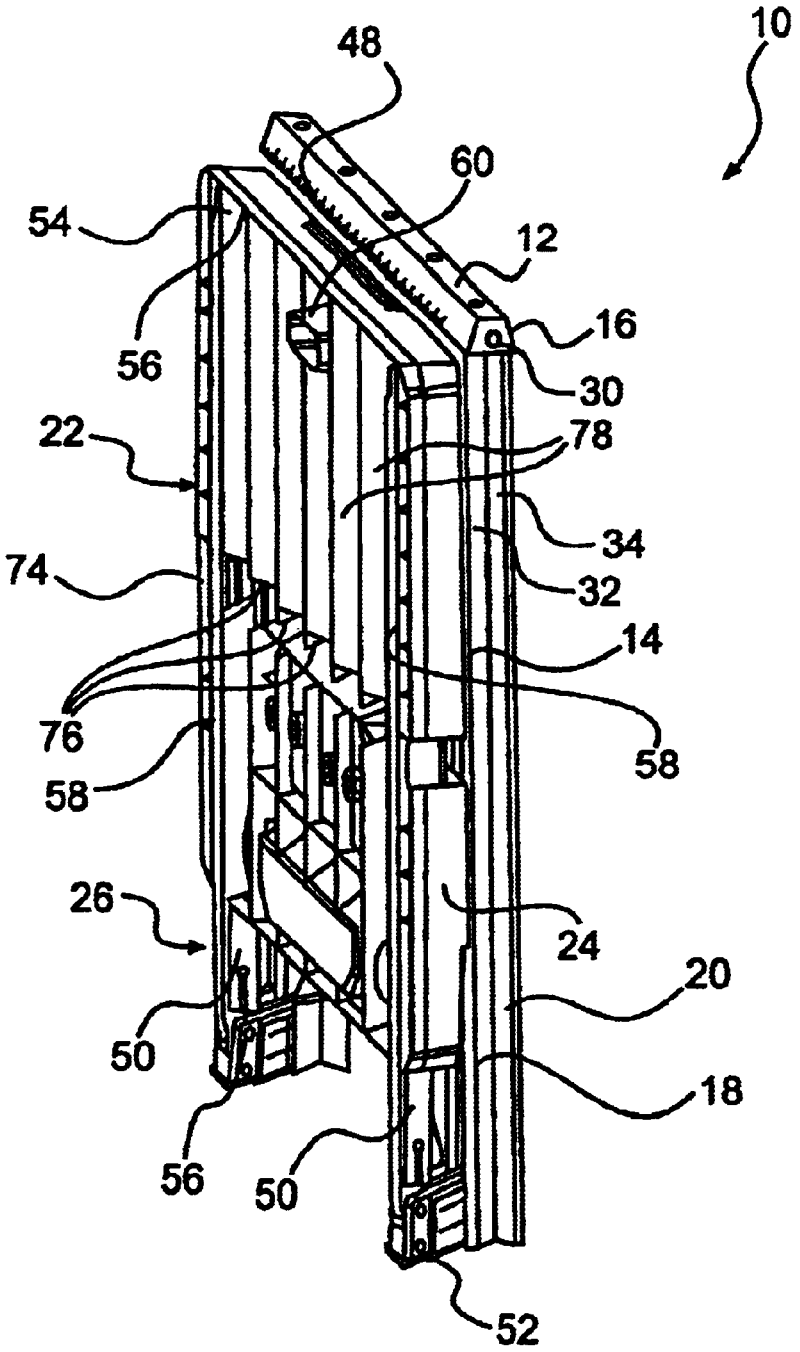
FIG. 3 is a perspective view of the workpiece support assembly in its closed folded configuration.

The mounting of the support members 18, 20 to each other and the mounting of the workpiece support structure 16 on the members 18, 20 is best appreciated from FIGS. 2–3. Preferably the members 18, 20 are pivotally mounted to each other at respective upper ends thereof by an elongated metallic rod 30. The rod 30 is also engaged with structure (not visible in the figures) integrally molded on the under side of the workpiece support structure 16 to mount the workpiece support structure 16 on the pair of support members 18, 20.

Each support member 18, 20 includes a pair of molded plastic legs 32, 34, respectively. The leg comprising each pair of legs are held in spaced relation by integrally molded upper and lower cross support structures 36, 38 and 40, 42, respectively. A folding shelf assembly 44 is mounted between perspective upper cross support structures 38, 42 of the support members 18, 20.

The details of the pivotal mounting of the support members 18, 20 to one another and to the workpiece support structure 16 and the details of the construction of the folding shelf assembly 44 are not discussed in detail in the present application but can be understood from examining commonly assigned U.S. patent application Ser. No. 09/372,669 now U.S. Pat. No. 6,298,946 which application is hereby incorporated by reference in its entirety into the present application for all material disclose therein.

The folding shelf assembly 44 limits of the movement of the support members 18, 20 in their opening direction and holds the members 18, 20 in their open operative position. A digit receiving opening 46 is formed in each side of the shelf assembly 44. Each opening 46 is constructed and arranged to receive, for example, a finger or thumb of a worker using the assembly 10 to begin upward folding movement of the shelf assembly 44 and thereby begin the movement of the support members 18, 20 toward one another into their folded position.

Outwardly facing surfaces of the workpiece support structure 16 are provided with a series of labeled (i.e., labeled with numbers and measurement units, for example) lines or line-forming structures 48 that comprise a ruler for taking linear measurements of a workpiece. The labels and the line-forming structures 48 can be, for example, integrally molded, raised surfaces, a layer of ink or other type of pigmented material, a plastic of a different color from the surrounding material, and so on.

Preferably, the tabletop support structure 26 is provided by a pair of elongated support arms 50. The tabletop assembly 22 is mounted to one of the support members such as support member 18. It can be appreciated that the support members 18, 20 are of essentially identical construction so that workpiece support assembly 10 can be constructed by mounting the tabletop assembly 22 to either of the support members 18, 20. Because the support members 18, 20 are essentially identical, only support member 18 will be discussed in detail, but the discussion applies equally to support member 20. It can be appreciated that the support members 18, 20 abut one another when in their folded position. It is contemplated, however, to provide an embodiment of the workpiece support assembly in which one support member is received (wholly or partially) within an appropriately shaped recess or opening in the other support member for compact storage when the workpiece support assembly is in its closed folded position. An example of this construction is shown in the above-incorporated application Ser. No. 09/372,669 now U.S. Pat. No. 6,298,946. It can be understood that the tabletop assembly 22 can be constructed to be mountable to either support member 18, 20.

A pair of connecting members 52 are each secured to the free end portion of a respective leg 32 of the support member 18 (each of the legs of the support member 18 being designated by the same reference numeral 32). Preferably each connecting member 52 is of molded plastic construction. Preferably, each connecting member 52 is mounted to the associated leg 32 using a snap-fit construction and a plurality of fasteners such as screws. The construction allows, for example, the tabletop assembly 22 to be removed from the sawhorse portion of the workpiece support assembly 10 if the user so desires. Each connecting member 52 can be removably mounted to the associated leg 32 in a wide range of ways, however, including, for example, by using any appropriate fasteners, by a snap-fit type of construction, with an adhesive or with any combination of these methods. It is also contemplated that each connecting member 52 be integrally formed (of a molded plastic, for instance) with the associated leg 32.

Preferably the arms 50 are pivotally connected between the associated connecting member 52 and arm-receiving structure 54 formed on the tabletop 24 in a position adjacent an edge portion of and on the underside of the tabletop 24. In the exemplary embodiment of the work support assembly 10, the pivotal mounting of the arms is accomplished by rivets 56 secured within aligned openings (not shown) in, respectively, the connecting members 52, the arms 50, and the arm-receiving structure 54. As best seen in FIG. 2, the underside of the tabletop 24 has integral grooves or recesses 58 of appropriate size and shape to receive the arms 50 for compact storage when the tabletop assembly 22 is in its closed, folded position adjacent the support member 18. Because the connecting members 52 are preferably removably mounted to the support member 18, the tabletop assembly 22 can, as mentioned, optionally be removed from the assembly 10. It is also contemplated to construct a tabletop assembly for mounting to a sawhorse as an after market-type product.

Figure 8:
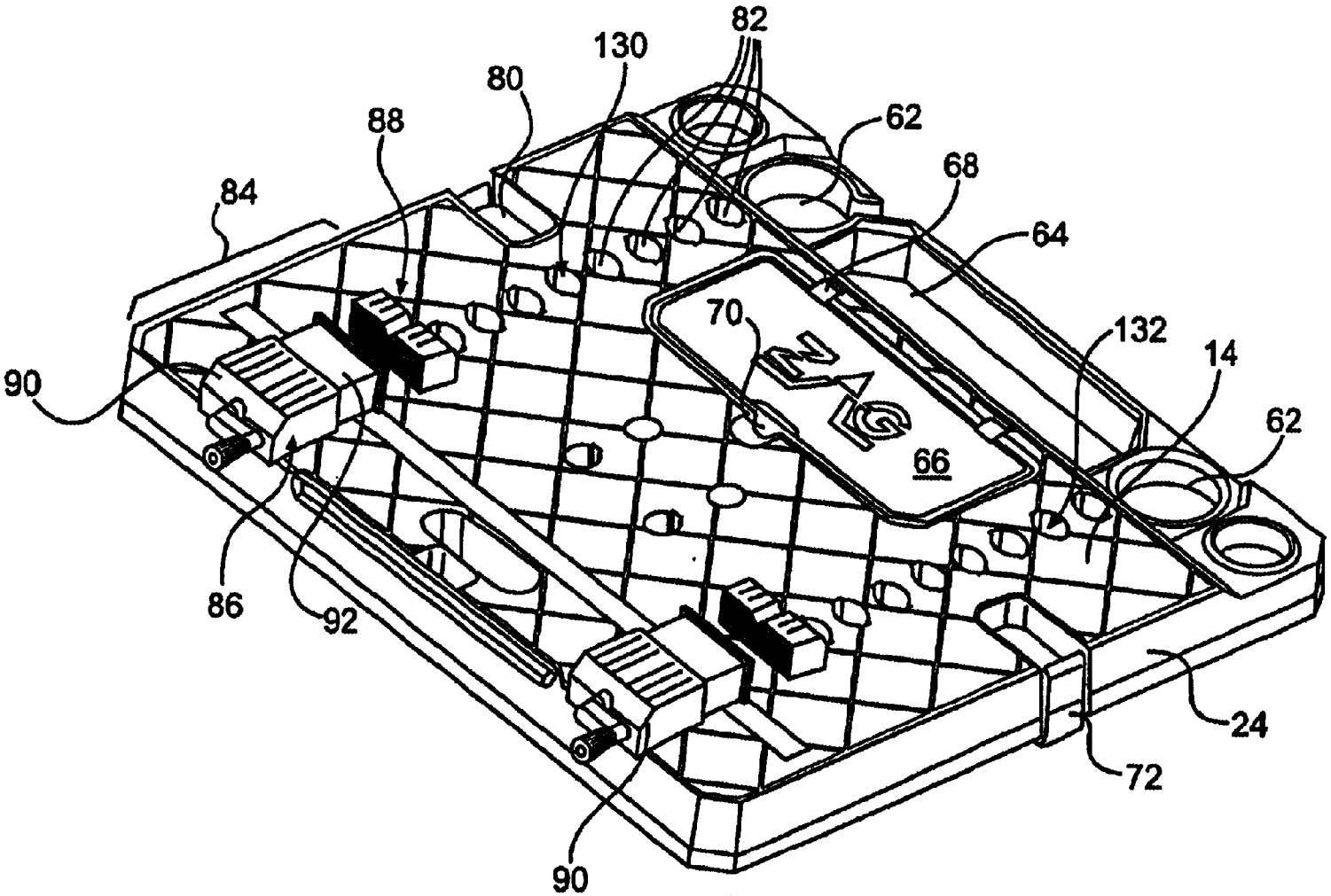
FIG. 8 is an isolated perspective view of a tabletop of the tabletop assembly showing and showing the pair of vise assemblies mounted thereon.

The details of the construction of the tabletop 24 can be best understood from FIGS. 2 and 3 (which show the underside of the tabletop) and from FIG. 8 (which shows the tabletop 24 in isolation). The tabletop 24 includes an integrally molded carrying handle 60 for carrying the work support assembly 10 in its folded position (FIG. 3, for example). It can be appreciated from FIG. 3 that the folded position of the workpiece support assembly 10 is realized when the tabletop assembly 22 is in its storage position and the support members 18, 20 are in their folded position. The tabletop 24 further includes a plurality of integrally molded open storage compartments 62, 64 and a closeable central storage compartment (not visible) having a lid 66.

The lid 66 is preferably of molded plastic construction and is shaped to have a pair of hinge structures 68 formed along one edge thereof and an integral latch structure 70 formed along an opposite edge. Preferably each hinge structure 68 is constructed and arranged to snap fit into pivotal engagement with appropriately shaped hinge receiving structure (not shown) integrally formed on the tabletop 24. The latch structure 70 is constructed and arranged to snap-fit into releaseably latched engagement with latch receiving structure (not visible) integrally formed on the tabletop 24. The lid 66 is flush with and forms part of the work support surface 14 of the tabletop 24 when the lid 66 is in its closed position. The central storage compartment can be used to store one or more vise assemblies (described below) when the vise assemblies are not in use.

A pair of table latches 72 are pivotally mounted on opposite edges of the tabletop 24 and are operable to latchingly engage associated end portions of the workpiece support structure 16 to releaseably lock the tabletop 24 thereto when the support assembly 10 is in its workbench configuration (see FIG. 1, for example). When the work support assembly 10 is in its workbench configuration, the elongated support structure 16 is received within a groove 74 formed on the underside the tabletop 24. The groove 74 (best seen in FIG. 3) is defined by a series of aligned notches 76 formed in a plurality of reinforcing ribs or wall members 78 formed on the underside of the tabletop 24. The ribs 78 rigidify and strengthen the tabletop 24. The notches 76 are sized to snugly receive the workpiece support structure 16. The table latches 72 prevent upward movement of the tabletop 24 away from the workpiece support structure 16. Thus, it can be understood the cooperation of this groove 74 and the table latches 72 securely holds the tabletop 24 on the elongated support structure 16 when the tabletop assembly 22 is in its deployed position.

A recess 80 is integrally formed in the tabletop 24 adjacent a respective table latch 72 for storage of the latch when the tabletop assembly 22 is in its storage position and not in use as a workbench. The recesses 80 allow the work surface 14 of the tabletop 24 to be placed against an outer flat surface portion of the support member 18 when the tabletop assembly 22 is in its closed storage position. This allows the tabletop assembly 22 to be flat against the support member 18 when the support members 18, 20 are in their open operative position to allow the support assembly 10 to be used in its sawhorse configuration without interference from tabletop assembly 22 and allows the support assembly 10 to be easily stored or stacked when the support members 18, 20 are in their closed position because the assembly 10 is essentially flat.

A plurality of spaced, aligned openings 82 are provided in the work surface 14 of the tabletop 24. The openings 82 are constructed and arranged to releaseably lockingly receive a vise assembly 84.

The structure and operation of the vise assembly 84 is best understood from FIGS. 9–14. The vise assembly generally includes two separate portions or pieces 86, 88. The first portion 86 of the vise assembly 84 includes a housing structure 90 and a movable member 92 (both of which may be constructed of a molded plastic material as shown, a metal material, or any other material of suitable strength) mounted for movement with respect to housing structure 90. The second portion 88 of vise assembly 84 is preferably of one-piece construction and will be referred to herein as the "fixed member" because, as will become apparent, when the vise assembly 84 is in use, the second portion 88 is in a fixed position with respect to the work surface 14. The fixed portion 88 of the vise assembly is preferably made of molded plastic material, although a metal material can be used in the construction.

Figure 9:
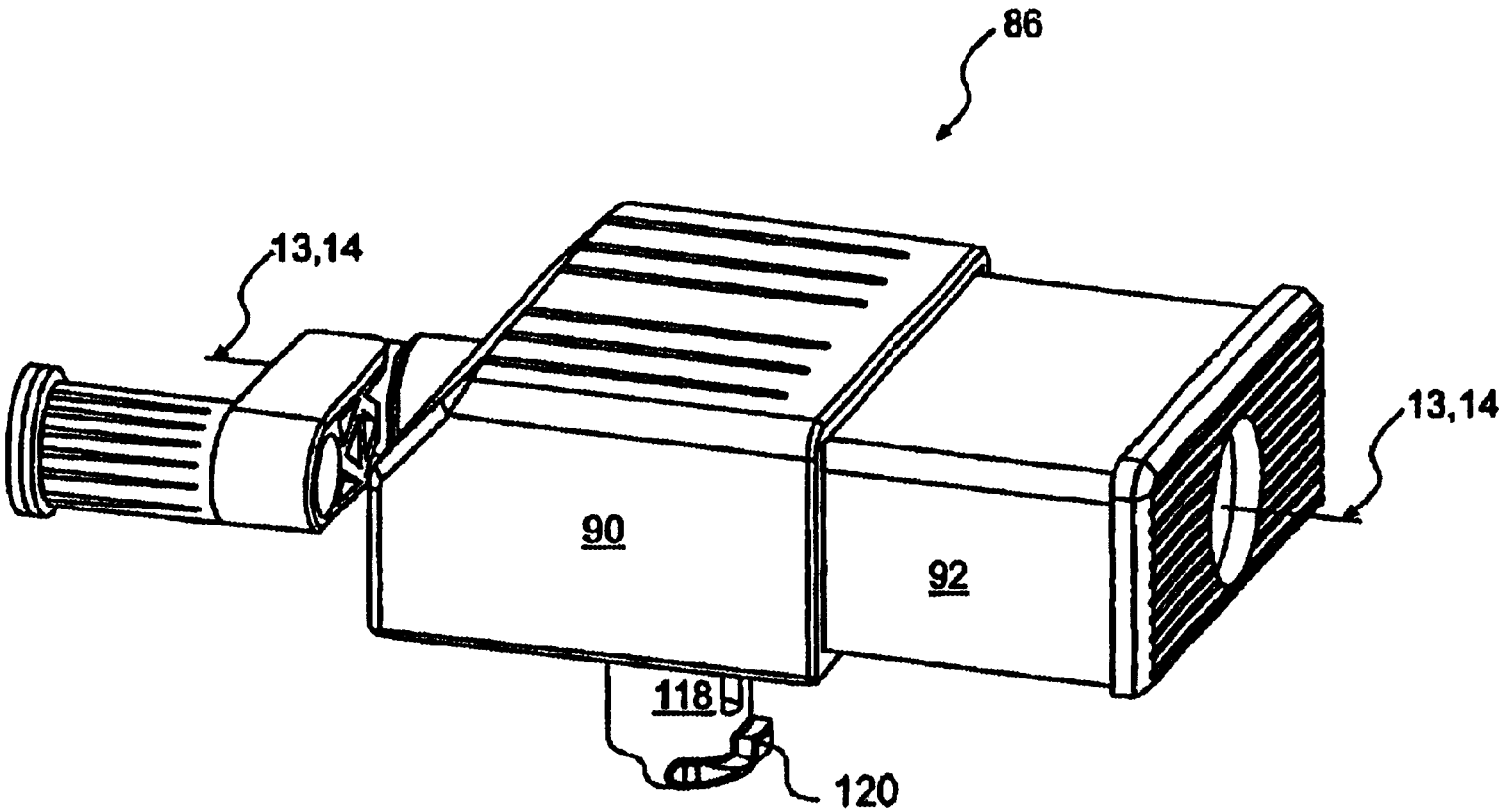
FIG. 9 is a perspective view of a first portion of the vise assembly showing a movable member in its extended position relative to a housing structure.

The manner in which the movable member 92 is mounted within a housing structure 90 is best appreciated from FIGS. 11–14. Specifically, a threaded member 94 rotatably mounted within a housing structure 90 is threadedly engaged with the movable member 92 such that rotation of the threaded member 94 moves the movable member 92 generally between extended and retracted positions with respect to the housing structure 90. The threaded member can be made of a molded plastic material, a metal material (as shown) or any other material of suitable strength. The extended position of the movable member 92 is shown in FIG. 9 and in cross-section in FIG. 13. The retracted position of the movable member 92 is shown in cross section in FIG. 14.

As best appreciated from the cross sections (FIGS. 13 and 14), a crank handle 96 is mounted on one end of the threaded member 94 by rivet or pin 97 and a radially enlarged end structure 98 is integrally formed on the opposite end of the threaded member 94. The radially enlarged structure 98 limits outward threaded movement of the movable member 92 with respect to the housing structure 90. It can also be appreciated from the cross sections of FIGS. 13 and 14 that one end of the threaded member 94 is rotatably mounted in an opening 100 formed within the housing structure 90 and that the threaded member 94 is prevented from moving axially by cooperation of the handle 96 and an annular shoulder 102 integrally formed on the threaded member 94.

Rotation of the handle 96 causes rotation of the threaded member 94 which in turn causes rectilinear movement of the movable member 92 between its extended and retracted positions. As best appreciated from FIGS. 11 and 12, a pair of guide posts 106 are integrally formed within the interior of the movable member 92 and are received within channels 108 of complementary configuration formed within the housing structure 90. Each channel 108 is formed within an axially extending structure 110 integrally formed within the housing structure 92. Preferably the exterior of each axially extending structure 110 is splined and tapered. The splined structure strengthens and rigidifies each axially extending structure 110 and, in combination with the tapering, reduces any frictional engagement between the exterior of the axially extending structures 110 and upper and lower interior walls surfaces 114, 116 of the housing structure 92.

The housing structure 92 and fixed member 88 each include locking structure constructed and arranged to allow each portion 86, 88 of the vise assembly 84 to be releaseably locked with respect to the support surface 14 of the tabletop 24. Specifically, each locking structure is comprised of a downwardly extending essentially cylindrical shaft or post 118 and a radially extending locking tab 120 (i.e., radial with respect to the central axis of the post 118) formed thereon. Each opening 82 in the tabletop 24 is slotted (slots are not shown) in an axial direction of the opening to receive the tab 120 and thereby allow the post 118 to move into a selected opening 82. When the post 118 is fully inserted, each opening 82 further includes a circumferentially extending locking slot (not shown) which allows limited circumferential movement of the tab 120 and therefore limited rotation of the post 118 within the opening when the post 118 is fully inserted therein. Movement of the tab 120 through the locking slot releasably locks that associated portion of the vise assembly onto the surface 14 of the tabletop 24.

Figure 10:
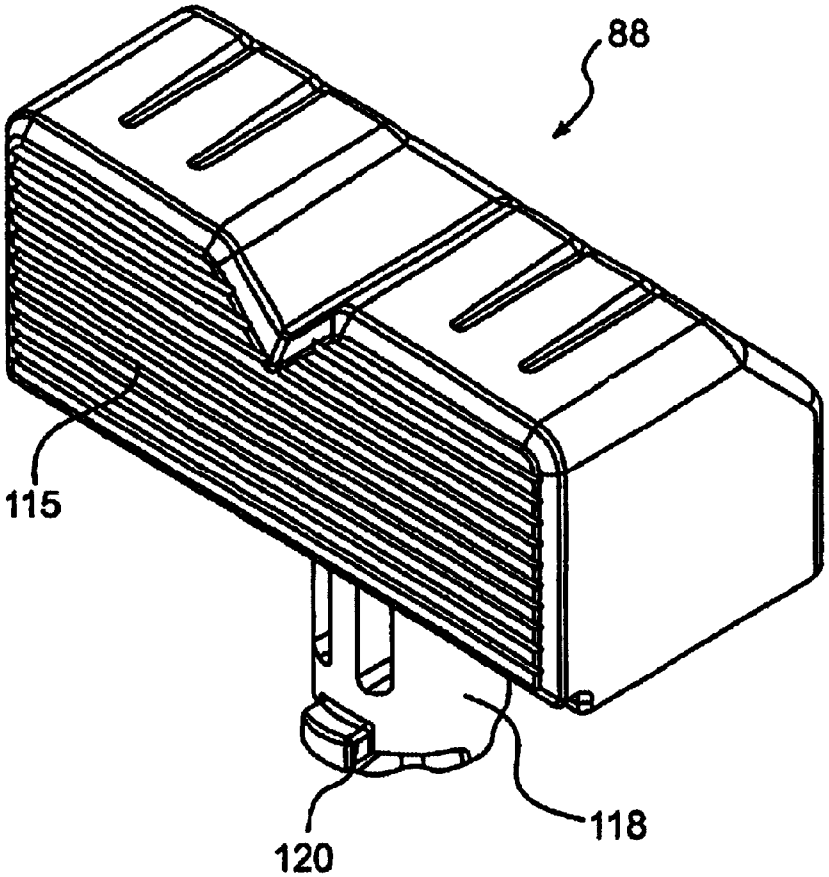
FIG. 10 is a perspective view of a second portion of the vise assembly.
Figure 11:
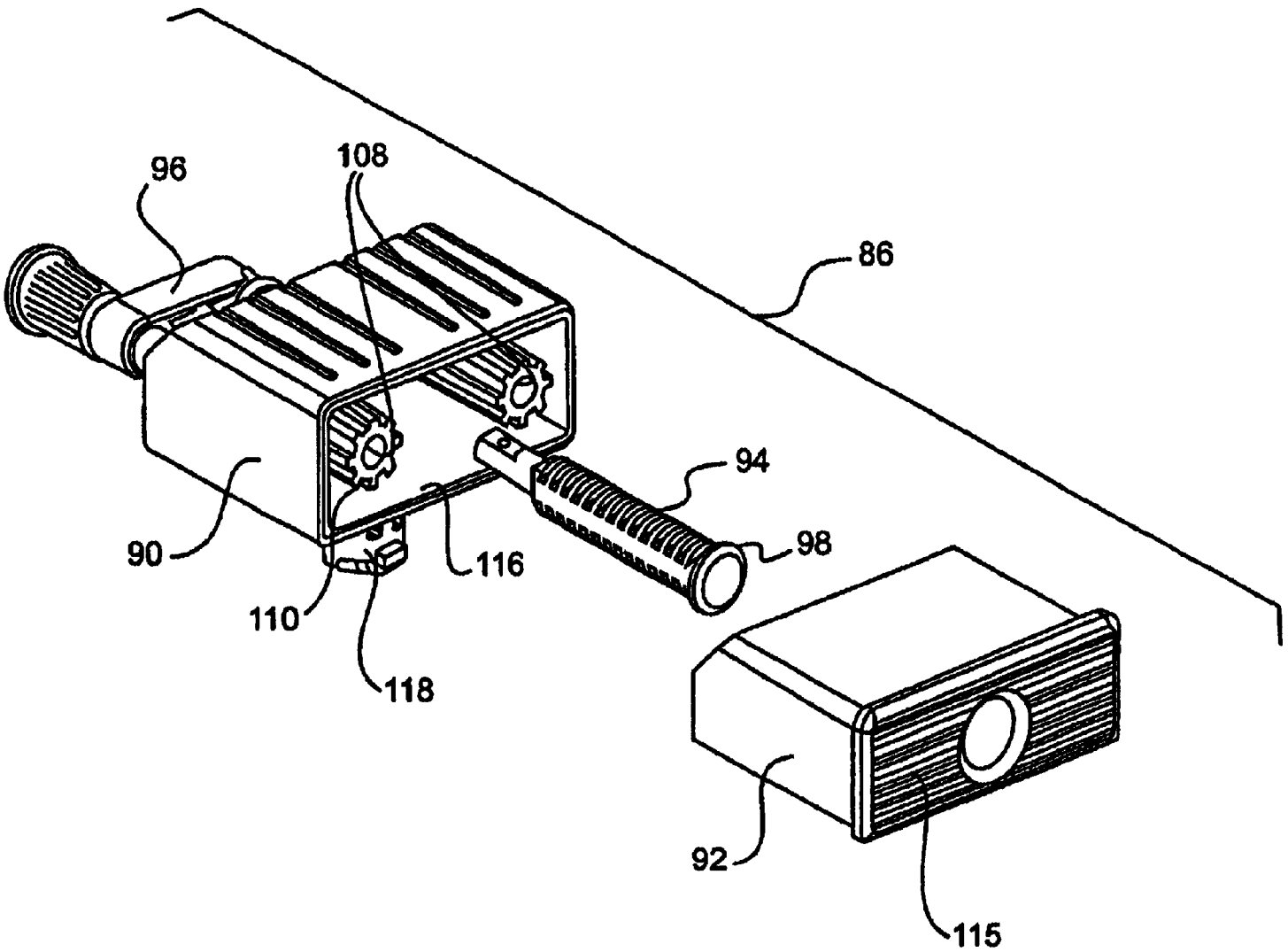
FIG. 11 is a partially exploded front view of the first portion of the vise assembly.
Figure 12:
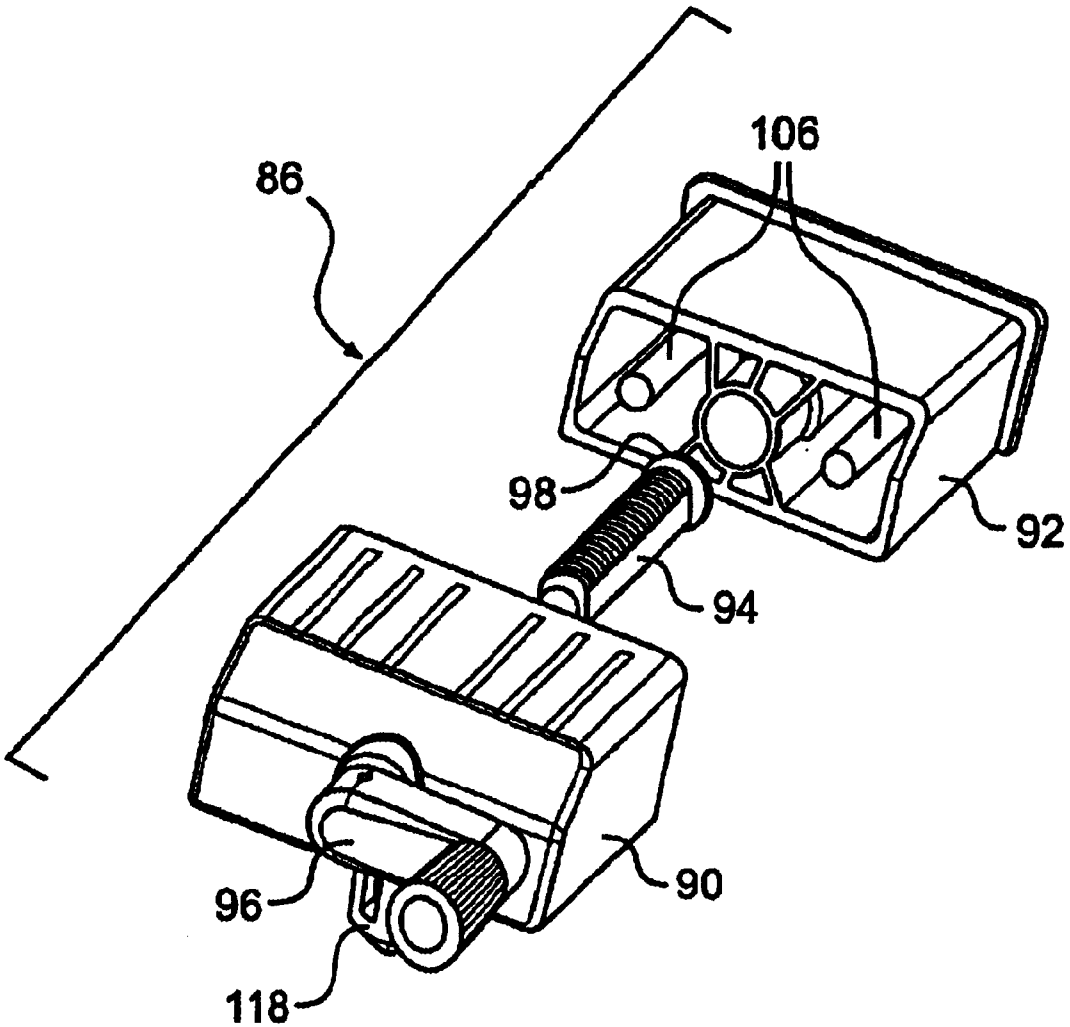
FIG. 12 is a view similar to FIG. 11 except showing a rear view of the vise assembly.
Figure 13:
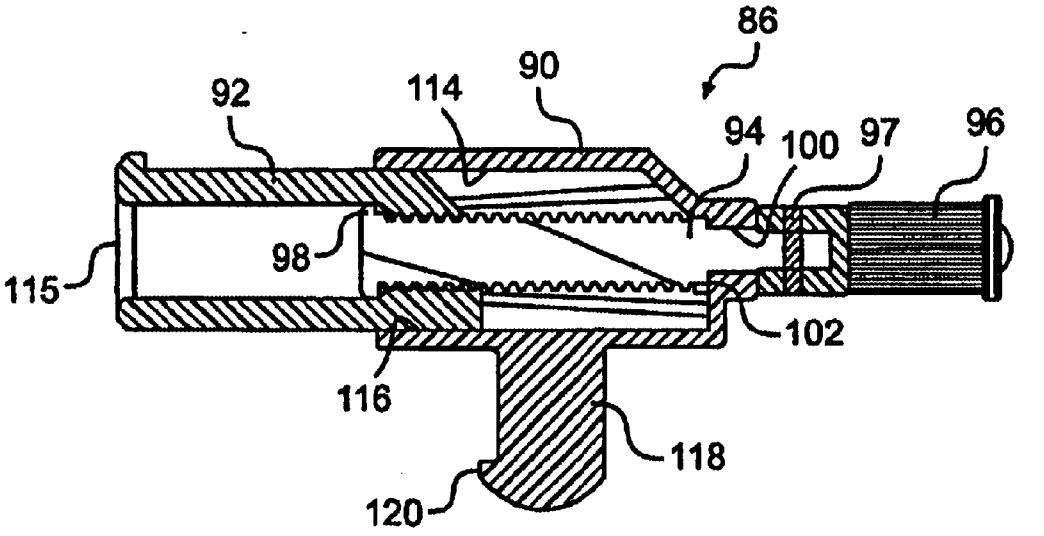
FIG. 13 is a cross-sectional view taken generally through the line 13—13 as shown in FIG. 9 except showing the movable member in its extended position.
Figure 14:
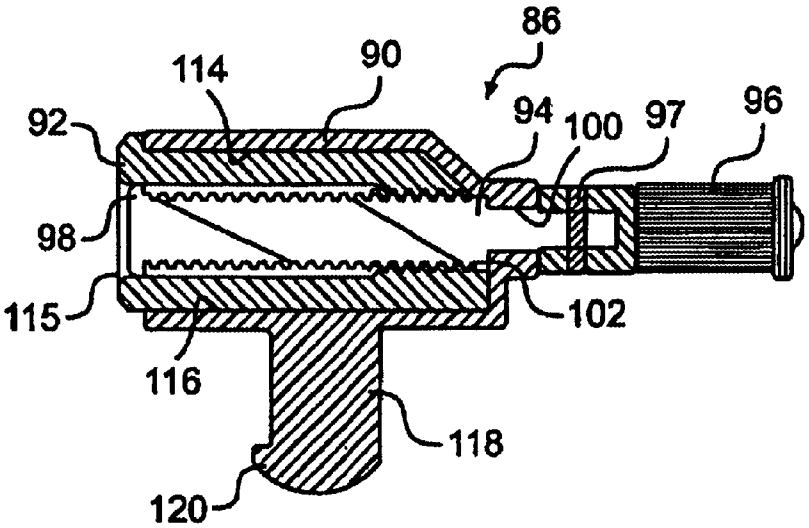
FIG. 14 is a cross-sectional view similar to FIG. 13 except showing the movable member in its retracted position.
Figure 15:
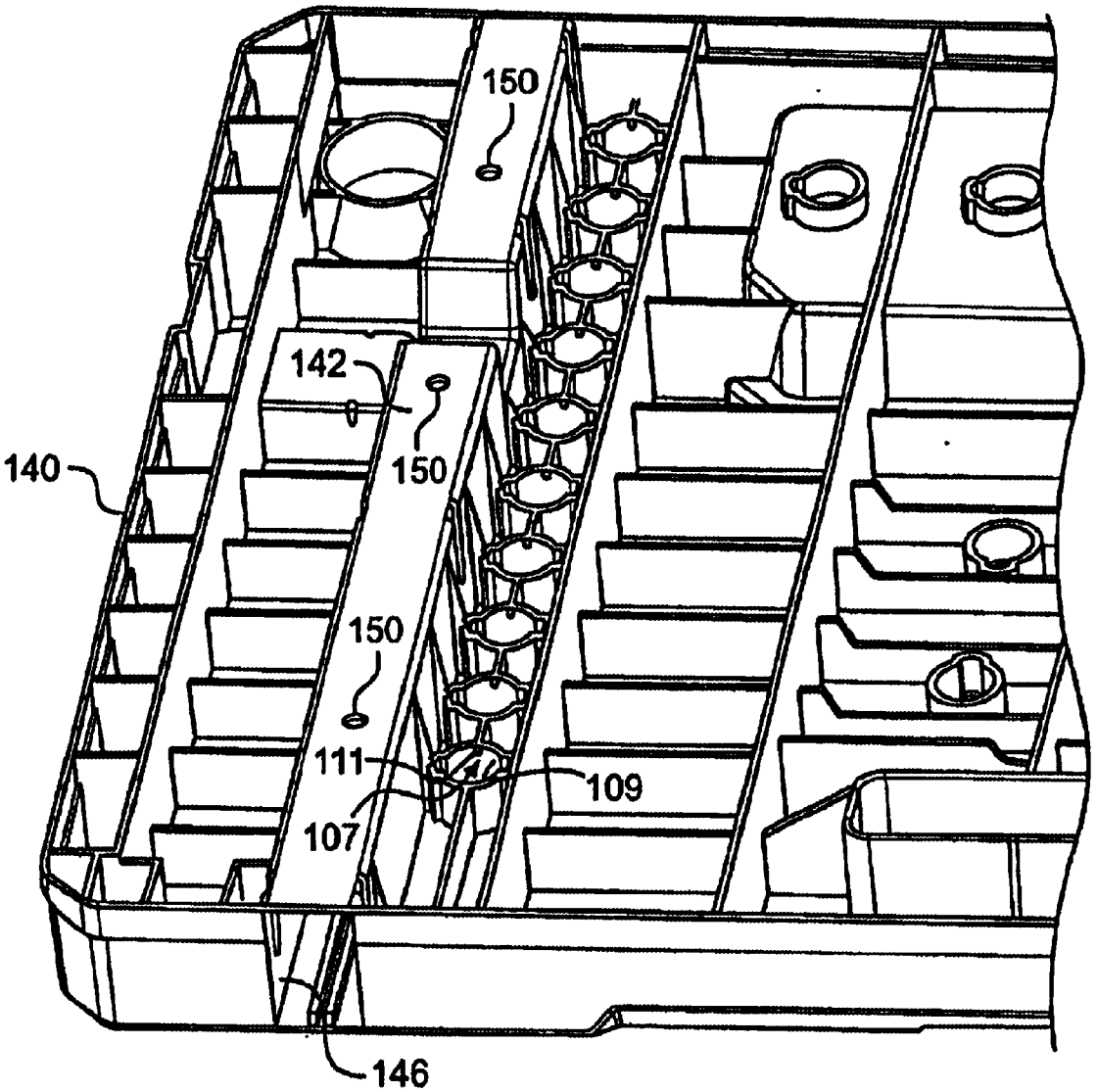
FIG. 15 is a partial perspective view of a tabletop according to another embodiment of the present invention.

Another example of an arrangement for locking the first and second portions 86, 88 of the vice assembly 84 can be appreciated from FIGS. 10 and 15. FIG. 15 shows an alternative embodiment of a tabletop 140 (described below) in isolation. A post 118 of the second portion 88 (see FIG. 10) includes a lock engaging element in the form of the tab 120. A wall structure 107 of each opening (such as opening 109 of tabletop 140 shown in FIG. 15) may be provided with a complimentary lock engaging element, shown in this example embodiment in the form of a groove 111 integrally formed in the plastic of the wall of the tabletop opening 109. The complimentary lock engaging element, or groove, 111 in each opening is constructed and arranged to releasably lockingly engage the tab 120 on the second portion 88. More specifically, the groove 111 and the tab 120 cooperate to help the user to determine when the portion 88 has been sufficiently rotated in a locking direction during installation on the tabletop 140. More specifically, as the user rotates portion 88, in a locking direction, the user will feel an initial resistance to rotation when the tab 120 of the post 118 of the second portion 88 (FIG. 10) contacts the wall structure 107. Further rotation in the locking direction causes the tab 120 to enter and engage the groove 111. The user will be able to tell when the tab 120 enters the groove 111 by the difference in resistance to rotation. The user will be able to tell, therefore, when he or she has rotated the second portion 88 sufficiently for installation. The engagement between tab 120 and the groove 111 will also help to keep the portion 88 properly aligned with the opposing first portion of the vice assembly. It can also be appreciated that a first portion (not shown) of the vice assembly can be provided with structure similar to that on the second portion 88 to aid in installation and alignment of the first portion. Thus, it can be understood that when the lock engaging elements, that is tabs 120, on the posts 118, engage respective lock engaging elements, that is grooves 111, in a respective opening, workpiece gripping surfaces 115 on the movable and fixed members 92, 88, respectively, are generally in opposing relation to one another, spaced from one another and generally parallel so that they are positioned to engage a workpiece place therebetween.

Operation

Figure 4:
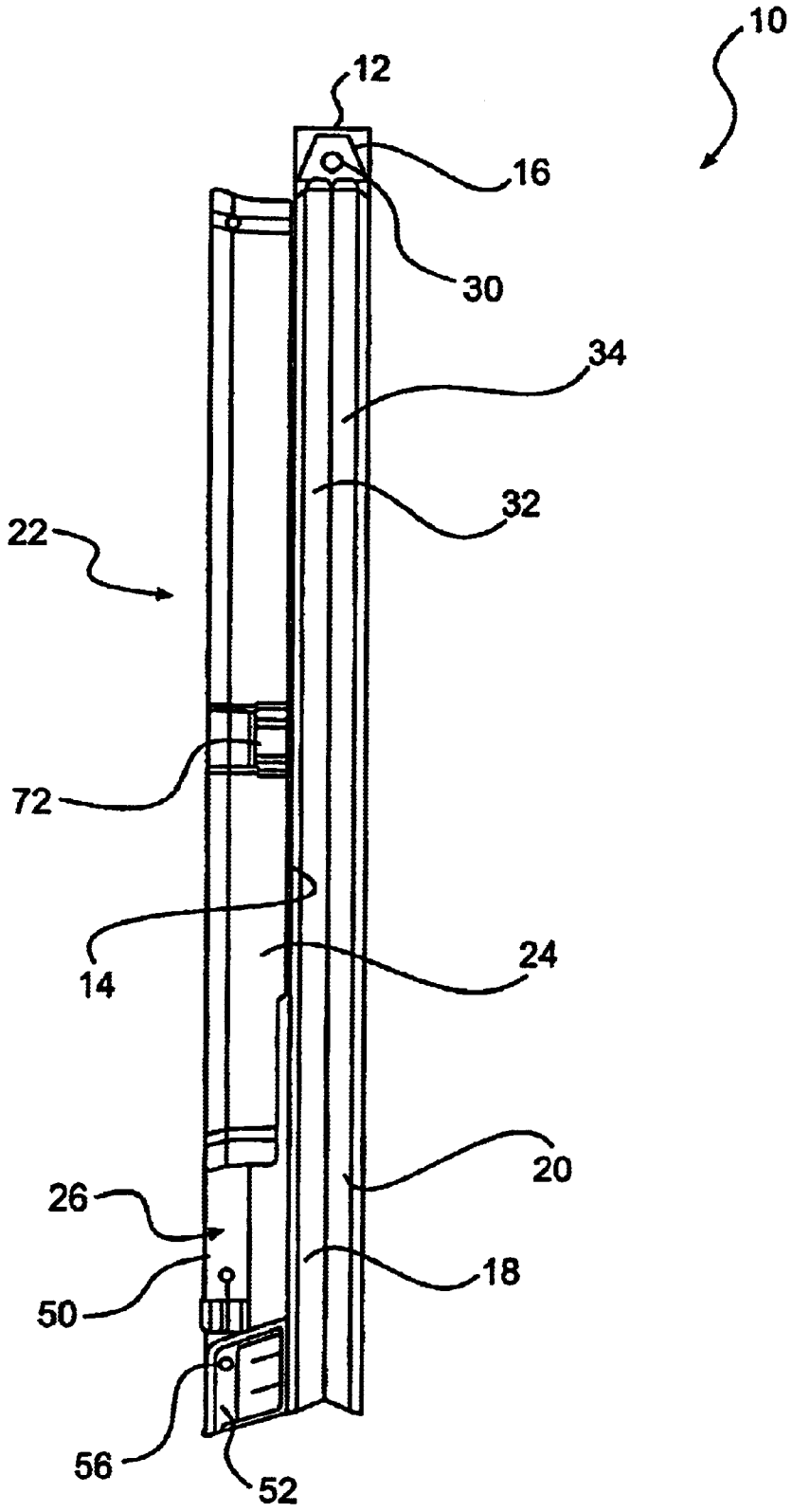
FIG. 4 is a side elevational view of the workpiece support assembly in its closed folded configuration.
Figure 5:
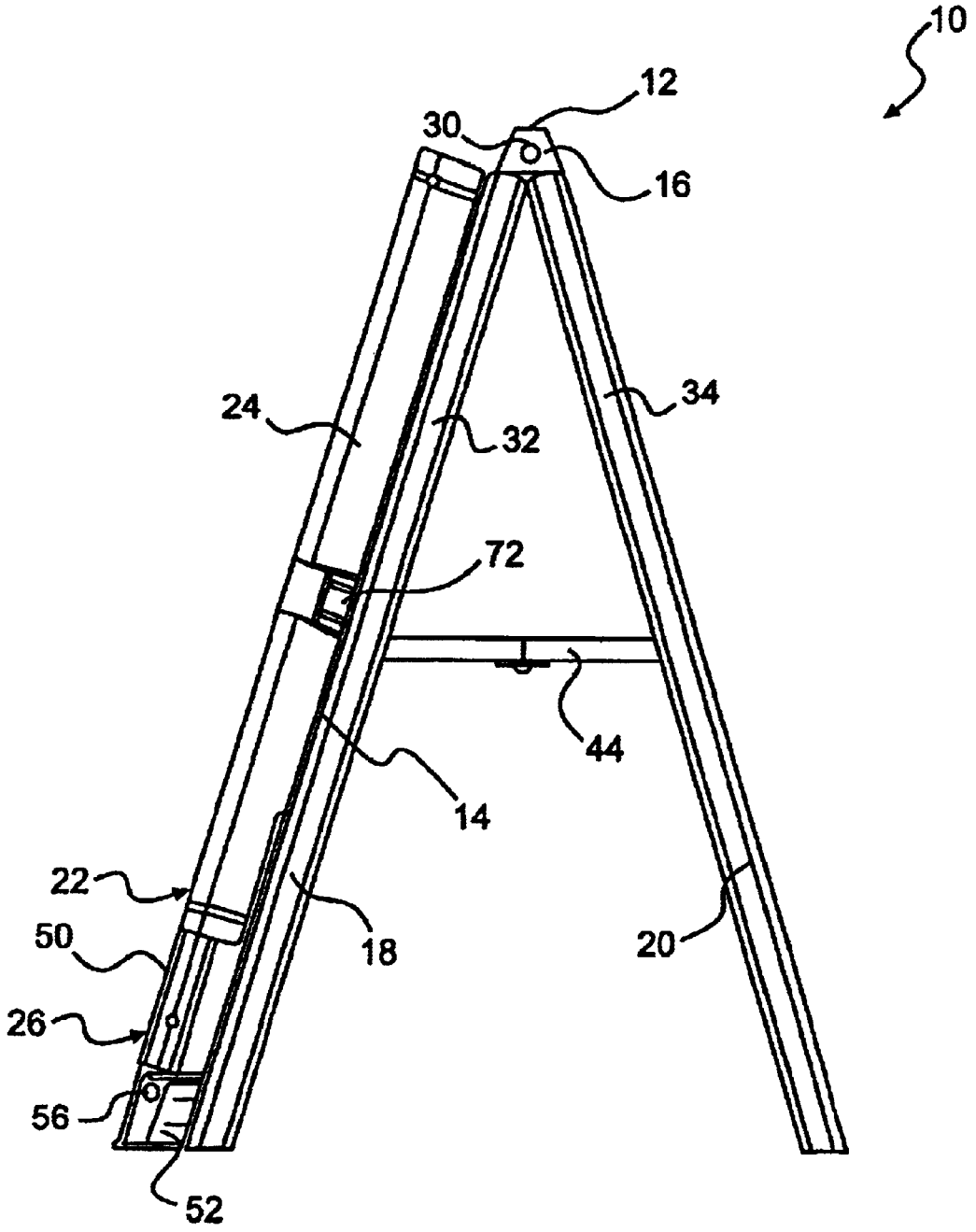
FIG. 5 is a side elevational view of the workpiece support assembly in its sawhorse configuration.
Figure 6:
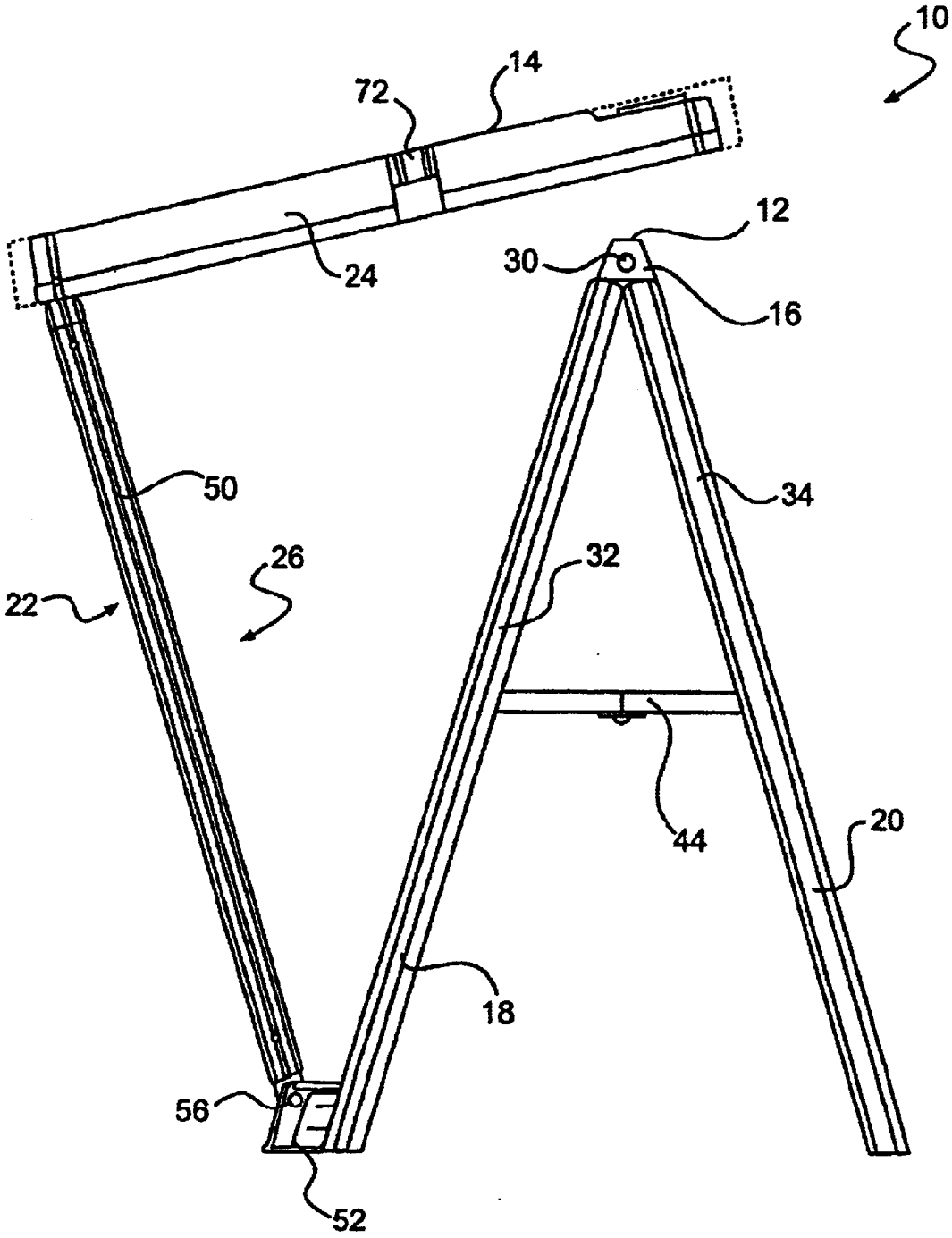
FIG. 6 is a side elevational view of the workpiece support assembly showing a tabletop assembly thereof in a position between its closed folded position and its deployed position.

The operation of the workpiece support assembly 10 can best be understood from FIGS. 4–7. FIG. 4 shows the support assembly 10 in its closed folded position. In this position, the tabletop assembly 22 is in its storage position in which it is adjacent support member 18, and the support members 18, 20 are together in their folded position. To use the support assembly 10 as a sawhorse, the support members 18, 20 are pivoted apart into their open operative position (FIG. 5). The folding shelf assembly 44 is in its unfolded open position and can be used to support tools or building materials while the assembly 10 is in use as a sawhorse. The tabletop assembly 22 is still in its storage position and is thus out of the way of a person using the assembly 10 as a sawhorse. The surface 12 is too narrow to be used by itself in supporting a workpiece for most construction tasks. Typically, a long workpiece such as a board or sheet of plywood is suspended between the narrow surfaces 12 of a pair of workpiece support assemblies 10.

Figure 7:
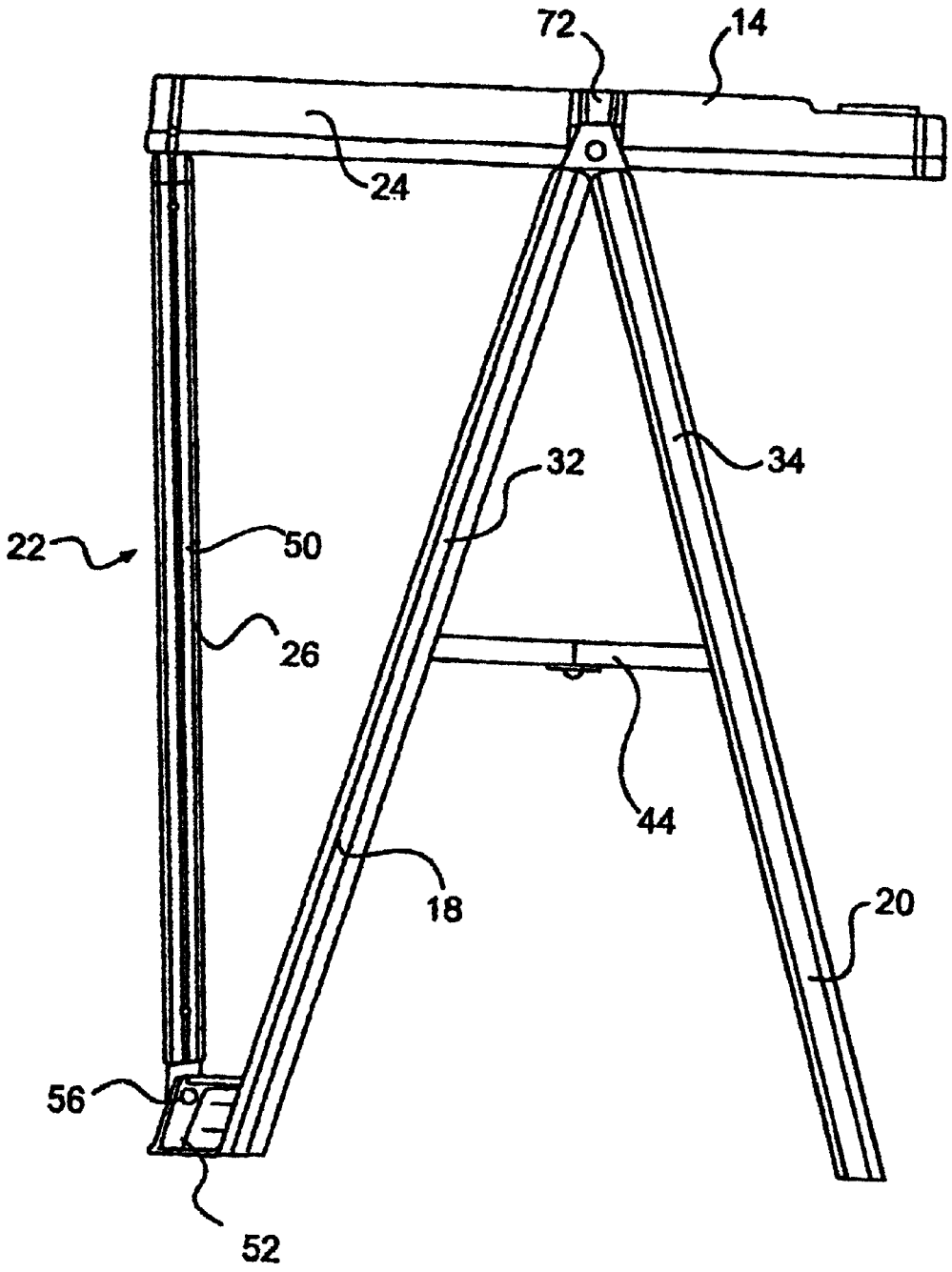
FIG. 7 is a side elevational view of the workpiece support assembly in its workbench configuration.

When a worker wishes to use the relatively wide support surface 14, the workpiece support assembly 10 can be moved into its workbench configuration. To accomplish this, the tabletop 24 is moved into its deployed position by essentially pivoting it on the support arms 50. This movement can be understood from comparing FIGS. 5–7. The tabletop 24 is placed in overlying relation to the workpiece support structure 16 with the groove 74 (not visible in FIGS. 5–7, but shown, for example, in FIG. 3) formed on the underside of the tabletop 24 placed over the workpiece support structure 16. The table latches 72 are moved into latching engagement with respective ends of the workpiece support structure 16. FIG. 7 shows the tabletop assembly 22 in its deployed position. The deployed tabletop 24 is supported by the cooperation of the arms 50 of the tabletop support structure 26 and the workpiece support structure 16.

A vise assembly 84 can be used to hold a workpiece on the work surface 14 of the tabletop 24 when the workpiece support assembly 10 is in its workbench configuration. To use a vise assembly 84, a worker removes the first and second portions 86, 88 of the assembly 84 from the central storage compartment of the tabletop 24 by opening the lid 66. It can be understood that the use of the central storage compartment to store one or more of the vise assemblies 84 is optional. The central storage compartment can be used to store other items as well, and is large enough to store one or more vise assemblies 84.

The first portion 86 of the vise assembly 84 is secured with respect to the work surface 14 by inserting the shaft 118 on the housing structure 90 into a selected opening 82 of the tabletop 24. When the shaft 118 is fully inserted in the selected opening 82, the housing structure 90 is turned or rotated to move the tab 120 into locking engagement with the circumferentially extending locking slot to lock the first portion 86 of the vise assembly 84 in its operating position on the tabletop 24. The fixed member 88 of the vise assembly 84 is mounted in a selected opening 82 in the same manner. In a preferred embodiment of the vise assembly 84 and tabletop 24, each portion 86, 88 of the vise assembly 84 is required to be pivoted or rotated approximately 45 degrees to move the each portion 86, 88 from its releasing position into stopped locking position and vice versa.

In the exemplary embodiment of the tabletop assembly 22 shown, two series or "lines" of opening's 82 are provided on the tabletop 24. The two series are designated 130, 132, respectively, and are best seen in FIG. 8. Preferably the two portions 86, 88 of a vise assembly 84 are placed in openings the same series 130 or 132, but this is not required. All of the opening 82 are identical and each portion 86, 88 can be mounted in any opening 82. It can be understood that the two portions 86, 88 of the vise assembly 84 are removed from locked engagement with the tabletop 24 by reversing the above-described sequence of operations for locking each portion 86, 88 the tabletop 24. That is, to remove each portion, each portion 86, 88 is pivoted from its locked, operative position into its unlocked position and then pulled upwardly away from the work surface 14 of the tabletop 24.

Preferably the housing structure 90 is releasably secured along an edge portion of the tabletop 24 so that the crank handle 96 extends outwardly beyond the work surface 14 to facilitate manual cranking movement of the handle 96. The fixed member 88 is then mounted to the tabletop 24 in a position relative to the housing structure 90 close enough so that movement of the movable member 92 toward its extended position grips the selected workpiece therebetween. Preferably, the fixed member 88 is placed as close as possible to the housing structure 90 while still accommodating the workpiece therebetween so that the user is required to turn the handle 96 as little as possible to grip the workpiece. The user can grip a workpiece using a single vise assembly 84 for smaller workpieces or can use a pair of vise assemblies 84 for larger workpieces.

To grip a workpiece in a vise assembly 84, the workpiece is placed between the two portions 86, 88 and the movable member 92 of the first portion 86 is moved towards its extended position using the crank handle 96 and into biasing engagement with the workpiece. The fixed portion 88 is positioned close enough to the housing structure 90 so that the workpiece is gripped between the movable member 92 and the fixed member 88 of the vise assembly 84 before the movable member 92 reaches its full extended position. The workpiece is released from the vise assembly 84 by rotating the crank handle 96 in the opposite direction to move the movable member 92 away from and out of biasing engagement with the workpiece.

The movable member 92 of the exemplary vise assembly 84 has a range of movement between extended and retracted positions of only approximately four cm, but workpieces of a wide range of sizes can be gripped by the vise assembly 84 by repositioning the fixed member (along series of openings) relative to the housing structure 90 of the vise assembly 84.

Thus, the fixed member 88 can be repositioned relative to the first portion 86 of the vise assembly 84 to accommodate a wide range of workpiece sizes, even if the range of movement of the movable member 92 relative to the housing structure 90 (that is, the range between its extended and retracted positions) is relatively small. Because each vise assembly 84 is relatively small, a pair of vise assemblies 84 can easily be stored in the central compartment and covered with the lid 66 when not in use.

The locking engagement between each tab 120 on the two portions of the vise assembly and the tabletop 24 prevents the two portions 86, 88 of the vise assembly 84 from being displaced upwardly away from the work surface 14 when the crank handle 96 is being tightened. The tabs 120 also prevent each portion 86, 88 of the vise assembly 84 from "bending" backwards (i.e., away from one another) as the vise assembly 84 is tightened.

Preferably there are two bars of metal 138 affixed to the under portion of the tabletop 24. Each metal bar 138 is positioned such that it extends under the tabletop 24 generally between the first portion and second portion 86, 88 of a respective vise assembly 84. The metal bars 138 strengthen and rigidify the tabletop 24, thereby preventing the tabletop 24 from bending or buckling while using one or both vise assemblies 84 to grip a workpiece. Each bar 138 is preferably secured to the tabletop 24 by screws or other fasteners.

Figure 16:
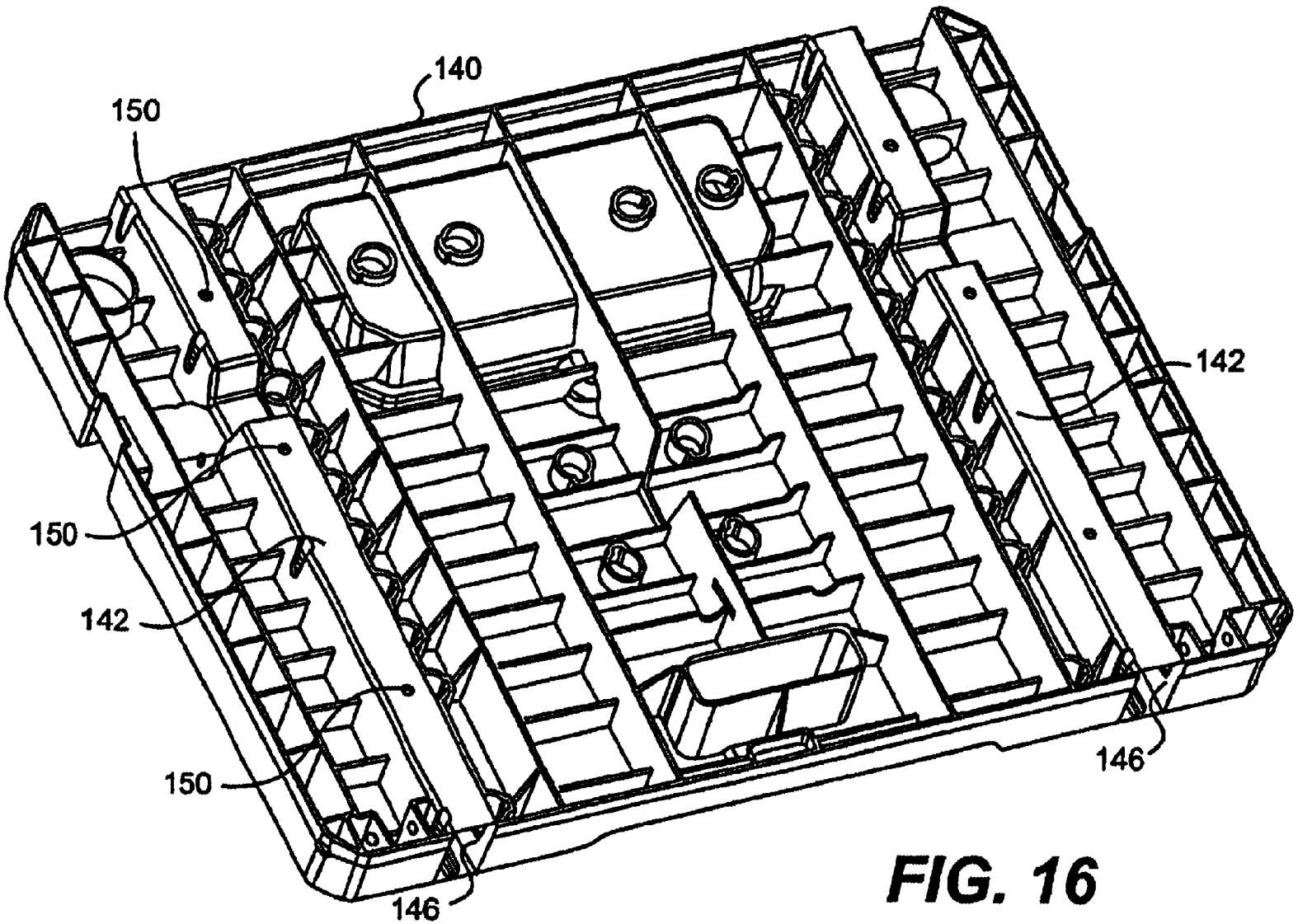
FIG. 16 is an isolated perspective view of the tabletop shown in FIG. 15.
Figure 17:
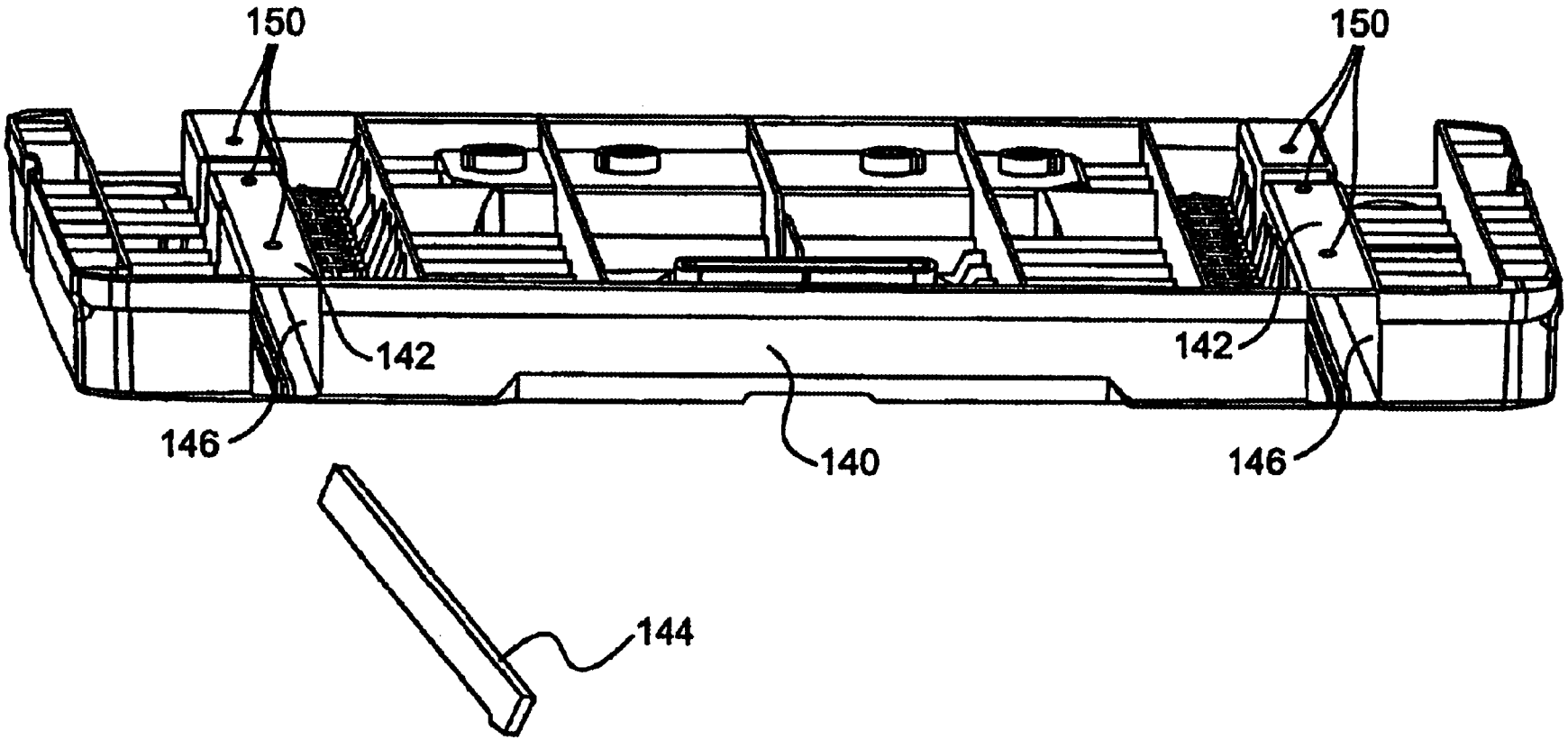
FIG. 17 is a perspective view of the tabletop shown in FIG. 15 shown with a reinforcing element in exploded relation therewith.

Another embodiment of a tabletop 140 of a tabletop assembly is shown in FIGS. 15–17. Structures and portions of the tabletop 140 that are identical to the tabletop 24 are identified with identical reference numbers and are not discussed further. The tabletop 140 includes a plurality of molded plastic core structures 142 integrally formed in the molded plastic of the tabletop, instead of the metal bars 138 that are affixed to tabletop 24, as seen in FIG. 2. Each core structure 142 has a closed cross section and extends under the upwardly facing surface of the tabletop. The core structures 142 are generally perpendicular to the elongated support structure 16 when the tabletop assembly is deployed. The closed cross sections of the core structures 142 are constructed and arranged to rigidify the tabletop. A plurality of elongated reinforcing elements 144 can optionally be secured within a hollow interior space 146 of a respective core structure 142 to further rigidify the tabletop 140. In the example tabletop 140, the reinforcing elements 144 are in the form of a plurality of metal strips or bars, one of which is shown in exploded relation with an associated core structure 142 in FIG. 17. The reinforcing elements 144 can be formed of any appropriate material including any appropriate metal, a solid plastic, wood, and so on. Each reinforcing element 144 can be secured within the interior space 146 of the associated core structure 142 with any appropriate fasteners (not shown) through openings 150 (see FIG. 15).

Each vise assembly 84 has many advantages including that each portion 86, 88 of each assembly 84 is very small, yet, because of the two-piece construction, both very small and very large workpieces can be gripped using the vise assembly 84. The two-piece construction allows a threaded member 94 of relatively short length to be used in the construction of the vise assembly 84 because the range of movement of the movable member does not need to be very large to accommodate both large and small workpieces.

It can be appreciated that the embodiments and descriptions of the workpiece support assembly and the vise assembly are intended to be exemplary only and not intended to limit the scope of the invention. Other embodiments of the work support assembly are contemplated and within the scope of the invention. For example, although the tabletop assembly is essentially permanently mounted to the work support assembly in the exemplary embodiment (where "permanently" means that the tabletop assembly is not normally removed during normal use of the support assembly), is contemplated to provide a work support assembly of two-piece construction in which the tabletop assembly is a separate piece of the assembly. When the work support assembly is of two-piece construction, the tabletop support structure can be mounted between the tabletop and a support member of the workpiece support assembly or, alternatively, one end of the tabletop support structure can be mounted to the tabletop in the opposite end can engage the ground directly. It is also contemplated to mount a tabletop assembly on an adjustable sawhorse of the types shown in the commonly assigned Ser. No. 09/372,669.

Figure 18:
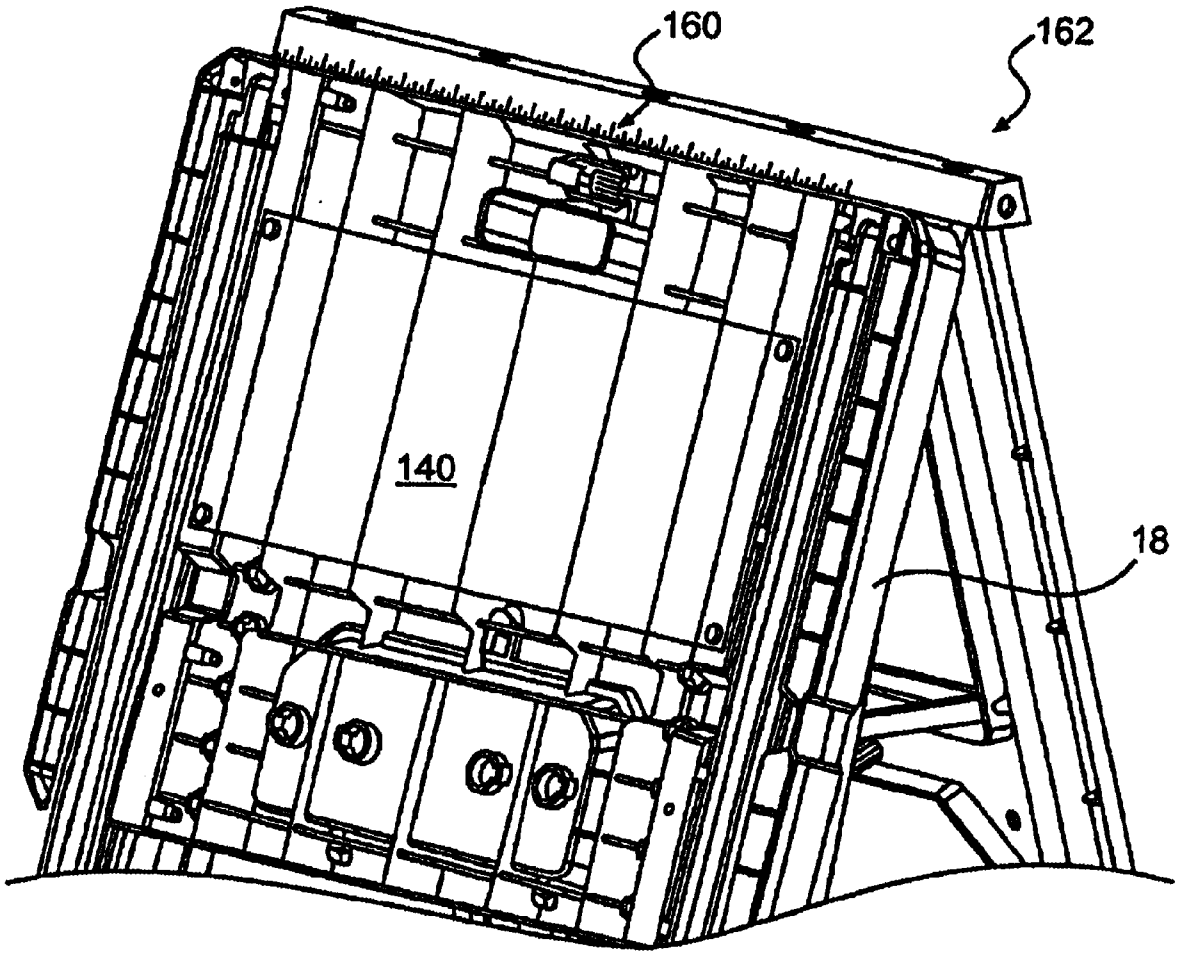
FIG. 18 is a partial perspective view of a workpiece support assembly constructed according to the principles of the present invention shown in use with the tabletop shown in FIG. 15.
Figure 19:
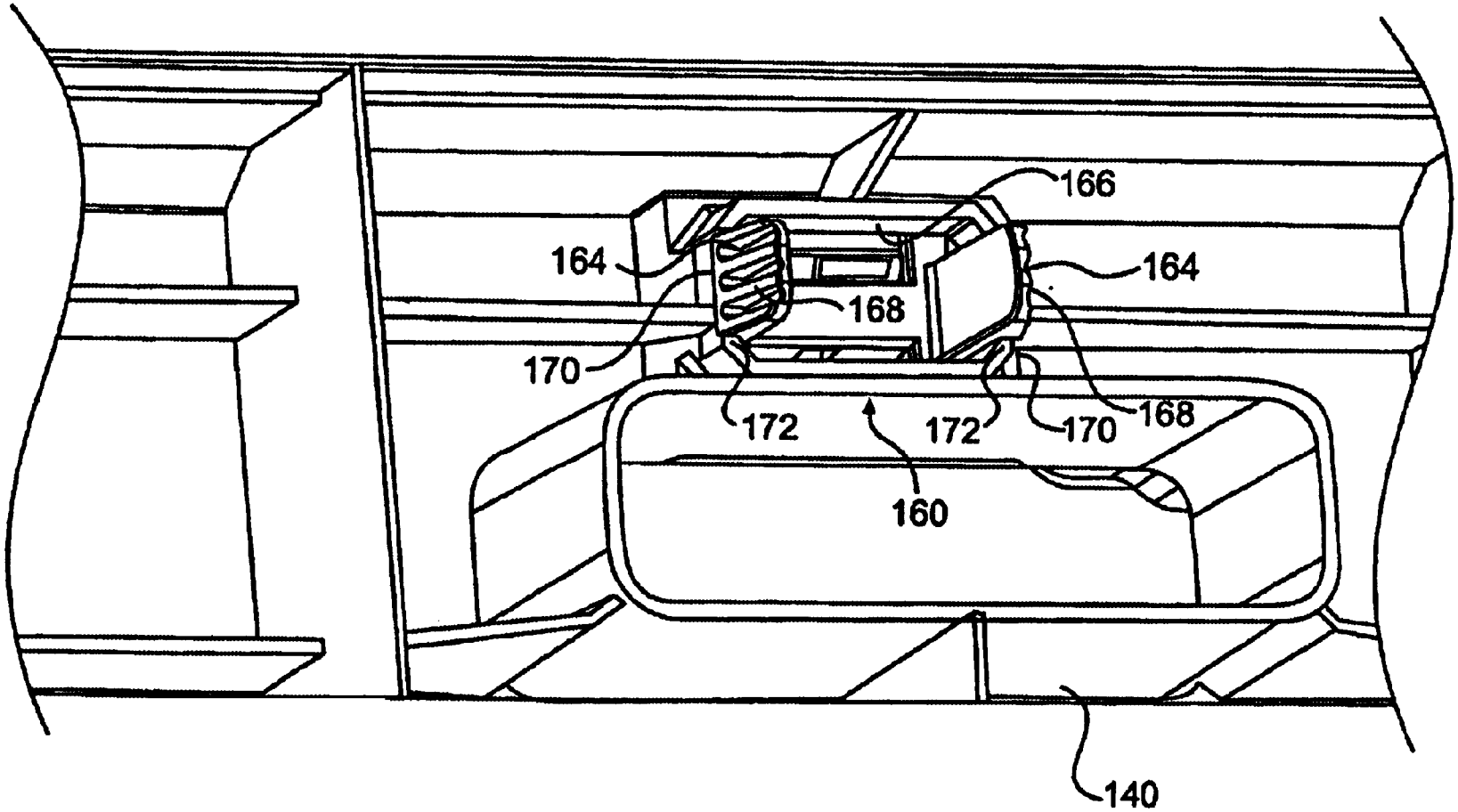
FIG. 19 is a detailed perspective view of a locking assembly.

It is also contemplated to provide a locking assembly to releasably lock the tabletop assembly in its storage position. An example locking assembly 160 is shown in FIGS. 18 and 19. The locking assembly 160 is shown mounted on a workpiece support assembly 162 that includes tabletop 140. The workpiece support assemblies 10, 162 are identical except that assembly 162 includes tabletop 140 and locking assembly 160. Identical structures between the two assemblies 10, 162 are identified with identical reference numbers and are not discussed in further detail.

The locking assembly 160 is comprised of a pair of molded plastic projections 164 (see FIG. 19) on one support member 18 and a molded plastic opening or recess 166 formed in the tabletop 140. Movement of the tabletop 140 into its storage position moves the pair of projections 164 on to a snap fit locking relation with the opening 166. To release the tabletop 140 from its locked storage position, the pair of projections 164 are moved manually into a released relation with the recess 166. More specifically, the plastic projections 164 are resilient, flexible structures that include gripping surfaces 170 that engage an outer edge surface 172 of the opening 166 in the unflexed position of the projections 164 to lock the tabletop 140 in its storage position. To deploy the tabletop, the user manually presses on outer surfaces 168, which flex the projections 164 toward one another so that surfaces 170, 172 move out of engagement with one another to release the tabletop 140. Movement of the tabletop 140 back into its storage position causes edge portions of the opening 166 to contact the angled surfaces 168. Further movement of the tabletop 140 toward its storage position moves the two projections 164 toward one another to allow the projections to pass through the opening 166. When the tabletop 140 reaches its storage position, the projections move back to their unflexed positions which engage surfaces 170, 172 to automatically lock the tabletop 140 in its storage position.

When the pair of support members 18, 20 are in their open position and the tabletop 140 is in its storage position, the tabletop 140 is releasably locked to the support member 18 in essentially side-by-side parallel relation therewith. When the tabletop is releasably locked in its storage position, the support members 18, 20 can be moved between their open operative and folded positions. When the tabletop 140 is releasably locked in its storage position and when the pair of support members 18, 20 are in their folded position, the support members 18, 20 and the tabletop 140 are disposed in essentially side-by-side parallel relation with one another. It is, of course, possible for the pair of projections to be provided on the table top 140, while an opening with which the projections lockingly engage may be formed within the support member 18.

Other embodiments of the vise assembly are also contemplated. For example, is contemplated to realize a vise assembly using two portions which both include movable members. For example, it is contemplated to construct a vise assembly using a pair of first portions 86 of the assembly 84.

Thus, it can be understood that while the invention has been disclosed and described with reference with a limited number of embodiments, it will be apparent that variations and modifications may be made to each embodiment without departing from the spirit and scope of the invention. Therefore, the following claims are intended to cover all such modifications, variations, and equivalents thereof in accordance with the principles and advantages noted herein.

What is claimed is:

1. A workpiece support assembly, comprising:

a pair of support members having upper ends, the pair of support members being pivotally connected to each other and movable between an open operative position and a folded position;

an elongated workpiece support structure mounted to the upper ends of the pair of support members in a generally horizontal spaced relation above a ground surface, wherein the elongated workpiece support structure includes a workpiece support surface; and a tabletop assembly including a tabletop with a tabletop surface and a tabletop support structure connected to the tabletop and one of the support members, wherein when the pair of support members are disposed in the open operative position, the tabletop assembly is movable between a deployed position in which the tabletop is disposed substantially horizontally over the workpiece support surface and a storage position in which the tabletop is disposed below the workpiece support surface so that the workpiece support surface is accessible for supporting a workpiece.

2. A workpiece support assembly as defined in claim 1 wherein said tabletop support structure is connected between said tabletop and a lower portion of one support member of said pair of support members.

3. A workpiece support assembly as defined in claim 2 wherein when said pair of support members are in the folded position thereof and said tabletop assembly is in the storage position thereof, said support members and said tabletop are disposed in essentially side-by-side parallel relation with one another.

4. A workpiece support assembly as defined in claim 2 further including a vise assembly comprising a housing structure, a movable member movably for movement with respect to said housing structure, a threaded member rotatably mounted in said housing structure and threadedly engaged with said movable member such that rotation of said threaded member moves said movable member with respect to said housing structure, and a fixed member, said housing structure and fixed member being releasably lockable with respect to said tabletop surface when said tabletop assembly is deployed such that a workpiece placed between said movable member and said fixed member can be held in a fixed position with respect to said tabletop surface by moving said movable member against said workpiece by rotating said threaded member so that said workpiece is gripped between said movable member and said fixed member.

5. A workpiece support assembly as defined in claim 4 wherein said fixed member can be releasably locked with respect to said tabletop surface in a range of positions relative to said housing structure to accommodate workpieces of different sizes.

6. A workpiece support assembly as defined in claim 5 wherein said vise assembly further includes a crank handle mounted to said threaded member to rotate said threaded member.

7. A workpiece support assembly as defined in claim 6 wherein said tabletop includes storage space to store said vise assembly.

8. A workpiece support assembly as defined in claim 7 wherein said elongated support structure, said pair of support members, said tabletop assembly and said fixed member, said movable member and said housing structure of said vise assembly are each constructed of a molded plastic.

9. A workpiece support assembly as defined in claim 1, wherein said tabletop includes a storage container.

10. A workpiece storage assembly as defined in claim 1, further comprising a locking assembly constructed and arranged to releasably lock said tabletop assembly in the storage position thereof.

11. A workpiece support assembly as defined in claim 10, wherein said tabletop support structure is connected between said tabletop and one support member of said pair of support members, wherein when said pair of support members are in the open position thereof and said tabletop assembly is in the storage position thereof, said one support member of said pair of support members and said tabletop are releasably locked to one another by said locking assembly in essentially side-by-side parallel relation with one another, and wherein when said tabletop assembly is releasably locked in the storage position thereof the support members are movable between the open operative and folded positions thereof.

12. A workpiece support assembly as defined in claim 11, wherein when said tabletop assembly is releasably locked in the storage position thereof and when said pair of support members are in the folded position thereof, said support members and said tabletop are disposed in essentially side-by-side parallel relation with one another.

13. A workpiece support assembly as defined in claim 12, wherein said elongated support structure, said pair of support members, said tabletop assembly and said locking assembly are each constructed of a molded plastic.

14. A workpiece storage assembly as defined in claim 13, wherein said locking assembly is comprised of a pair of molded plastic projections on one of either the tabletop or the one support member and a molded plastic recess on the other of either the tabletop or the one support member, the pair of projections being constructed and arranged such that movement of the tabletop assembly into the storage position thereof moves the pair of projections on to a snap fit locking relation with the recess and wherein said pair of projections are manually movable into a released relation with the recess to deploy the tabletop assembly.

15. A workpiece support assembly as defined in claim 1, wherein said elongated support structure, said pair of support members, and said tabletop assembly are each constructed of a molded plastic.

16. A workpiece storage assembly as defined in claim 15, said tabletop assembly further including a plurality of molded plastic core structures integrally formed in the tabletop of the tabletop assembly, each core structure having a closed cross section and extending under the upwardly facing surface of the tabletop and generally perpendicularly to said elongated support structure when said tabletop assembly is deployed, said plurality of core structures being constructed and arranged to rigidify said tabletop.

17. A workpiece storage assembly as defined in claim 16, further comprising a plurality of elongated reinforcing elements, each elongated reinforcing element being secured within a hollow interior space of a respective core structure to further rigidify said tabletop.

18. A workpiece storage assembly as defined in claim 17, wherein each said elongated reinforcing element is constructed of a metallic material.

19. A workpiece storage assembly as defined in claim 11, further comprising a vise assembly comprising a housing structure, a movable member movably mounted for movement with respect to said housing structure, a threaded member rotatably mounted in said housing structure and threadedly engaged with said movable member such that rotation of said threaded member moves said movable member with respect to said housing structure, and a fixed member, said housing structure and said fixed member being releasably lockable with respect to said tabletop surface when said tabletop assembly is deployed such that a workpiece placed between said movable member and said fixed member can be held in a fixed position with respect to said tabletop surface by moving said movable member against said workpiece by rotating said threaded member so that said workpiece is gripped between said movable member and said fixed member.

20. A workpiece support assembly as defined in claim 19 wherein each of said housing structure and said fixed member includes a locking structure having a lock engaging element and wherein said tabletop surface includes a plurality of spaced openings, each opening including a complimentary lock engaging element constructed and arranged to releasably lockingly engage the lock engaging element on the locking structure inserted therein, said openings being spaced to enable said housing structure and said fixed member to be positioned a range of distances from one another on said tabletop surface, said fixed member, said housing structure and said openings being instructed and arranged such that when said lock engaging elements on said housing structure and said fixed member, respectively, engage the complimentary locking elements in a respective opening, workpiece gripping surfaces on the movable and fixed members respectively are generally in opposing relation to one another and spaced from one another to engage a workpiece placed therebetween.

21. A workpiece support assembly as defined in claim 20 wherein said elongated support structure, said pair of support members, said tabletop assembly and said fixed member, said movable member and said housing structure of said vise assembly are each constructed of a molded plastic.

22. A workpiece support assembly, comprising:

a pair of support members with upper ends and lower ends, the upper ends of each support member being pivotally connected together such that the pair of support members are movable between a folded position in which the pair of support members are substantially parallel and an open position in which the upper ends of the support members are adjacent and the lower ends of the support members are spaced apart; and a tabletop assembly having a tabletop with a table surface and a tabletop support structure pivotally connected between the tabletop and the lower ends of the pair of support members, wherein the tabletop assembly is movable between a deployed position in which the tabletop is supported by the tabletop support structure with the table surface in a horizontal position and a storage position in which the tabletop is folded with the table surface against one of the support members.

* * * * *